US007802524B1

(12) United States Patent
Gregar

(10) Patent No.: US 7,802,524 B1
(45) Date of Patent: Sep. 28, 2010

(54) CONSTANT CONTACT SIDE BEARING ASSEMBLY WITH IMPROVED CAP MACHINING FOR A RAILCAR

(75) Inventor: Peter P. Gregar, Chesterton, IN (US)

(73) Assignee: WABTEC Holding Corp., Wilmerding, PA (US)

( * ) Notice: Subject to any disclaimer, the term of this patent is extended or adjusted under 35 U.S.C. 154(b) by 0 days.

(21) Appl. No.: 12/539,115

(22) Filed: Aug. 11, 2009

(51) Int. Cl.
*B61F 3/00* (2006.01)

(52) U.S. Cl. ..... 105/199.3; 384/423

(58) Field of Classification Search ..... 105/199.3, 105/199.4, 19.49; 384/423
See application file for complete search history.

(56) References Cited

U.S. PATENT DOCUMENTS

| | | | | |
|---|---|---|---|---|
| 2,250,134 | A * | 7/1941 | Pointer | 280/439 |
| 2,756,691 | A * | 7/1956 | Masel et al. | 105/185 |
| 3,730,104 | A * | 5/1973 | Hood, II | 105/199.3 |
| 6,092,470 | A * | 7/2000 | O'Donnell | 105/199.3 |
| 6,581,527 | B2 * | 6/2003 | Hewitt | 105/199.3 |
| 6,644,214 | B1 * | 11/2003 | Schorr | 105/199.3 |
| 7,121,212 | B2 * | 10/2006 | Schorr et al. | 105/199.3 |
| 7,338,034 | B2 * | 3/2008 | Aspengren et al. | 267/3 |
| 2004/0187726 | A1 * | 9/2004 | Schorr et al. | 105/199.3 |
| 2004/0261652 | A1 * | 12/2004 | Berg et al. | 105/182.1 |
| 2005/0087092 | A1 * | 4/2005 | McKisic et al. | 105/199.3 |
| 2006/0042498 | A1 * | 3/2006 | Schorr et al. | 105/199.3 |
| 2008/0035012 | A1 * | 2/2008 | Monaco et al. | 105/199.3 |
| 2008/0035013 | A1 * | 2/2008 | Johnstone et al. | 105/199.3 |
| 2008/0115690 | A1 * | 5/2008 | Mitchell et al. | 105/199.3 |
| 2008/0141896 | A1 * | 6/2008 | O'Donnell et al. | 105/199.3 |
| 2008/0173211 | A1 * | 7/2008 | Kennedy | 105/199.3 |

* cited by examiner

*Primary Examiner*—S. Joseph Morano
*Assistant Examiner*—Jason C Smith
(74) *Attorney, Agent, or Firm*—James Ray & Assoc

(57) ABSTRACT

A constant contact side bearing assembly includes a housing, a cap and an elastomeric resilient compressible element mounted within the interior chamber. The exterior surface of the cap wall has a generally even circumferential region which does not include protrusions or cavities other than small irregularities that are common to a casting process by which the cap of the present invention is manufactured. Accordingly, the anti-rotational tabs are positioned below this region and are operatively received within the channels disposed on the housing.

10 Claims, 5 Drawing Sheets

CONSTANT CONTACT SIDE BEARING ASSEMBLY WITH IMPROVED CAP MACHINING FOR A RAILCAR

FIELD OF THE INVENTION

The present invention relates, in general, to energy absorption devices for railcars and, more particularly, this invention relates to a constant contact side bearing assembly mounted between a bolster of a wheeled truck and an underside of the railcar body for controlling "hunting" movements of the railway car and, yet more particularly, the instant invention relates to an improved constant contact side bearing assembly having a cap with an exterior surface region thereof that can be machined without interruption by a turning process on the lathe.

BACKGROUND OF THE INVENTION

Constant contact side bearings mounted between a bolster of a wheeled truck and an underside of the railcar body are generally well known for controlling "hunting" movements of the railway car. Typically, such constant contact side bearing assembly includes a housing, a cap that is mounted for reciprocal axial movement within the housing and an elastomeric element mounted within the interior confines of the assembly. The housing is fastened to the bolster while the upper end of the cap is in constant contact with underside of the railway car body. A pair of channels are disposed on the housing in open communication with the interior thereof and a pair of complimentary mating anti-rotational tabs are disposed on the exterior surface of the cap for restricting the rotation of the cap relative to the housing. The channels and tabs span the entire height of the housing and cap respectively.

In order to meet operating clearance mandated by the railroads, the interior surface of the housing and the exterior surface of the cap are machined to close tolerances. While the interior surface of the housing can be machined by a turning process on the lathe, the protruding tabs interfere with turning operation and thus must be machined by way of a milling process. The milling process increases the manufacturing costs of the cap and, therefore, increases manufacturing costs of the entire side bearing assembly.

Therefore, there is a need for an improved constant contact side bearing assembly having a cap thereof with an exterior surface region that can be machined without interruption by a turning method.

SUMMARY OF THE INVENTION

The invention provides a constant contact side bearing assembly for a railcar. The constant contact side bearing assembly includes a housing. The housing includes a base having a substantially planar bottom surface thereof abuttingly engaging a bolster of a railcar truck and defining a bottom end of the housing. The base also includes a pair of mounting apertures formed through a thickness of the base and aligned along a mounting axis disposed each of generally perpendicular to an axis of such bolster and in a movement direction of such railcar. The housing further includes a generally cylindrical housing wall upstanding on the base and defining an upstanding longitudinal axis of the housing generally intersecting the mounting axis of the mounting apertures, the housing wall having each of a predetermined height and a predetermined diameter. There is also at least a pair of diametrically opposed channels disposed on and extending outwardly from an exterior surface of the housing wall in open communication with an interior thereof and aligned along an axis disposed substantially perpendicular to the mounting axis. Each of the at least pair of diametrically opposed channels has a generally U-shaped cross-section in a plane transverse to the longitudinal axis of the housing. At least a pair of diametrically opposed openings are formed at least through a thickness of the base. Each of the at least pair of diametrically opposed openings is disposed in general alignment with a respective one of the at least pair of channels. Finally, the housing includes a first guide member disposed centrally on and upstanding from an inner surface of the base member. The constant contact side bearing assembly further includes a cap disposed for reciprocal axial movement relative to the housing along the upstanding longitudinal axis thereof. The cap has each of a predetermined height and a predetermined diameter. The cap includes a generally cylindrical cap wall defining a longitudinal axis of the cap disposed coaxially with the longitudinal axis of the housing. A generally even circumferential region of an exterior surface of the cap wall provides for an uninterrupted machining of the exterior surface during rotation of the cap about the longitudinal axis thereof wherein a cutting tools travels along a pass being parallel to the longitudinal axis of the cap. The cap further includes a generally closed top end having a pair of substantially planar surfaces and carrying thereon a top edge of the cap wall. The cap also includes a generally open bottom end defining a bottom edge of the cap wall. There is at least a pair of diametrically opposed tabs disposed on the exterior surface of the cap wall. Each of the at least pair of diametrically opposed tabs each of sized and shaped for operative engagement with a respective one of the at least pair of channels, wherein an upper edge of each of the at least pair of diametrically opposed tabs disposed at or below the generally even circumferential region of the cap wall and whereby the combination of the channels and tabs is sized to withstand rigors of an operating environment of such railcar. The cap finally includes a second guide member disposed centrally on and upstanding on an inner surface of the top end of the cap. The final essential element of the constant contact side bearing assembly is a one piece elastomeric spring disposed within a generally closed chamber formed by a combination of the housing and the cap. The spring has an axial bore sized to receive each of the first and second positioning members.

OBJECTS OF THE INVENTION

It is, therefore, one of the primary objects of the present invention to provide an improved constant contact side bearing assembly having a cap with an exterior surface region thereof that can be machined without interruption by a turning process on the lathe.

Another object of the present invention is to provide an improved constant contact side bearing assembly having a cap with an exterior surface region thereof that can be machined without interruption by a turning process on the lathe that also has anti-rotational tabs disposed on the cap below the exterior surface region of the cap to be machined.

Yet another object of the present invention is to provide an improved constant contact side bearing assembly having a cap with an exterior surface region thereof that can be machined without interruption by a turning process on the lathe that further has opening disposed in the housing to receive such anti-rotational tabs.

A further object of the present invention is to provide an improved constant contact side bearing assembly having a cap with an exterior surface region thereof that can be machined without interruption by a turning process on the lathe that can withstand operational rigors.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
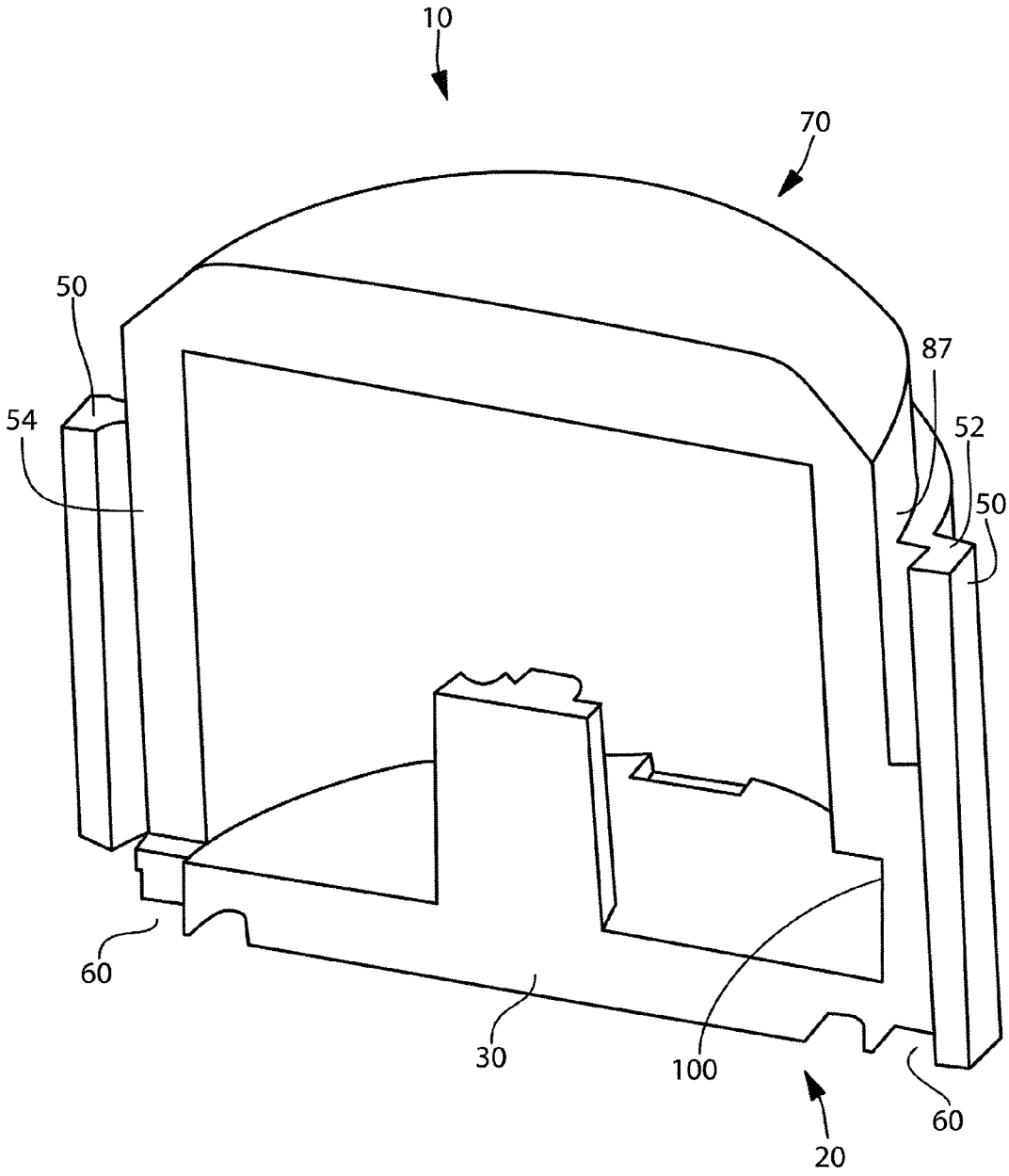
FIG. 1 illustrates a 3-D cross-sectional view of a constant contact side bearing assembly of the present invention.

Prior to proceeding to the more detailed description of the present invention, it should be noted that, for the sake of clarity and understanding, identical components which have identical functions have been identified with identical reference numerals throughout the several views illustrated in the drawing figures.

The present invention provides a constant contact side bearing assembly, generally designated as 10, for a railcar 2. The side bearing assembly 10 comprises a housing, generally designated as 20, a cap, generally designated as 70, and an elastomeric resilient compressible element, generally designated as 140.

Now, in a particular reference to FIGS. 1-2 and 4-5, the housing 20 includes a generally oval base 30 having a substantially planar bottom surface 32 thereof abuttingly engaging the upper surface of the bolster 6 of a railcar truck 4 and defining a bottom end 22 of the housing 20. A pair of mounting apertures 38 are formed through a thickness of the base 30 and are aligned along a mounting axis 39 disposed each of generally perpendicular to an axis 5 of such bolster 6 and in a movement direction of such railcar 2. Each mounting aperture 38 is disposed in close proximity to and spaced from an end 36 of the base 30.

The housing 20 also has a generally cylindrical housing wall 40 upstanding on the base 30 and defining an upstanding longitudinal axis 24 of the housing 20 generally intersecting the mounting axis 39 of the mounting apertures 38. The housing wall 40 has each of a predetermined height and a predetermined diameter. As is conventional, the ends 36 of the base 30 extend past the exterior side surface 42 of the housing wall 40 so as to allow unobstructed access to the apertures 38.

Figure 2:
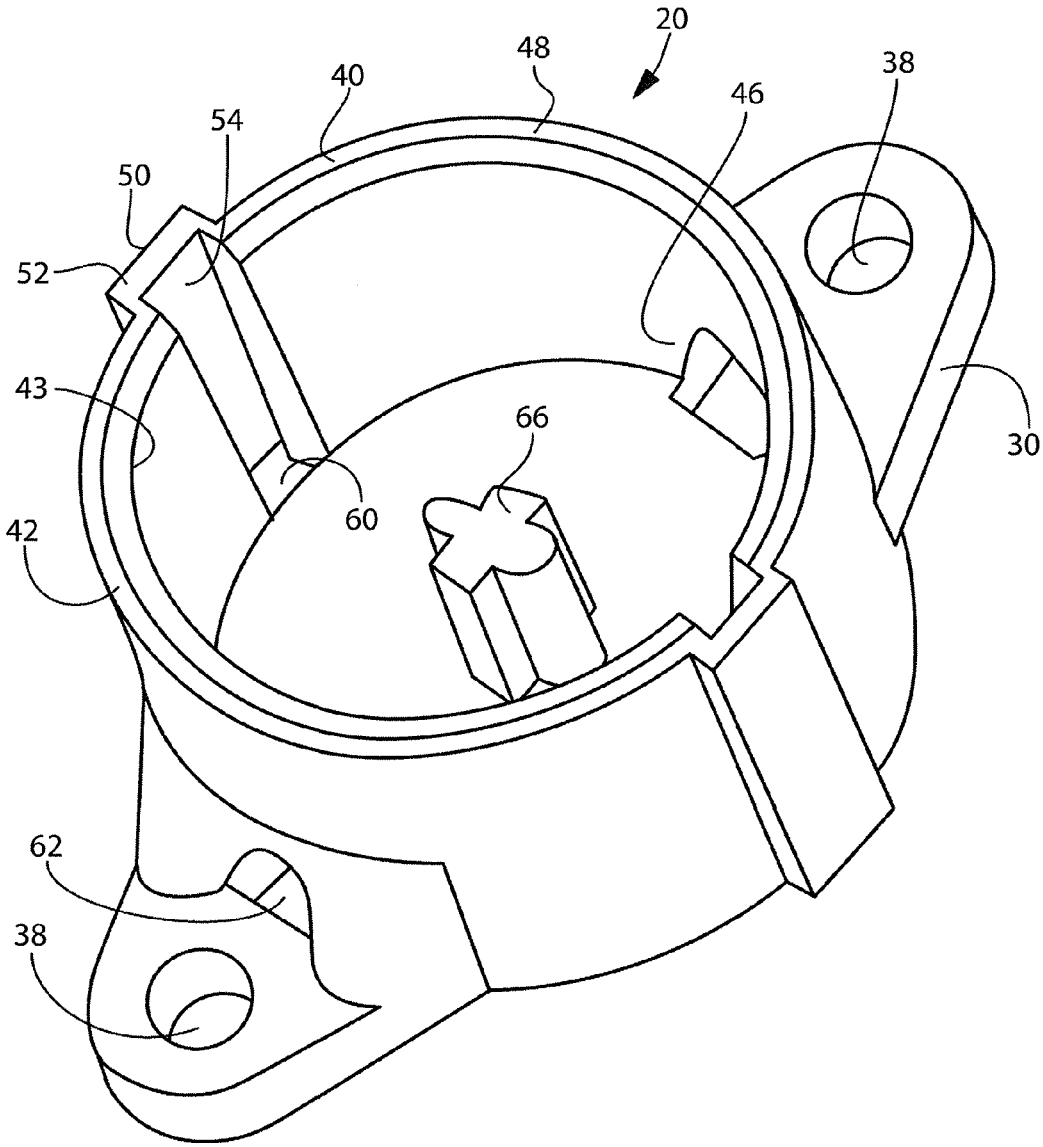
FIG. 2 illustrates a 3-D view of the housing member employed within the constant contact side bearing assembly of FIG. 1.

Two diametrically opposed channels 50 are disposed on and extending outwardly from the exterior surface 42 of the housing wall 40 in open communication with an interior 46 thereof and aligned along an axis disposed substantially perpendicular to the mounting axis 39. Each channel 50 has a generally U-shaped cross-section in a plane transverse to the longitudinal axis 24 of the housing 20. A top edge 52 of each channel 50 may be positioned generally planar with a top edge 48 of the housing wall 40 as best shown in FIG. 2, or may be disposed anywhere along the height of the exterior surface 42 of the housing wall 40.

A pair of first diametrically opposed openings 60 are formed at least through a thickness of the base 30, each complimentary alignment with a respective channel 50 and is each of sized and shaped generally identical to the cross-sectional inner area of such respective channel 50. The openings 60 may be further formed through the lower portion of the channel 50, as best shown to the left of FIGS. 1-2.

The housing 20 may also include a pair of second diametrically opposed openings 62 formed at least through the thickness of the housing wall 40 and further preferably formed through the thickness of the base 30. The second diametrically opposed openings 62 are aligned along the mounting axis 39.

Finally, a first elongated guide member 66 is disposed centrally on and upstanding from an inner surface 34 of the base member.

Figure 3:
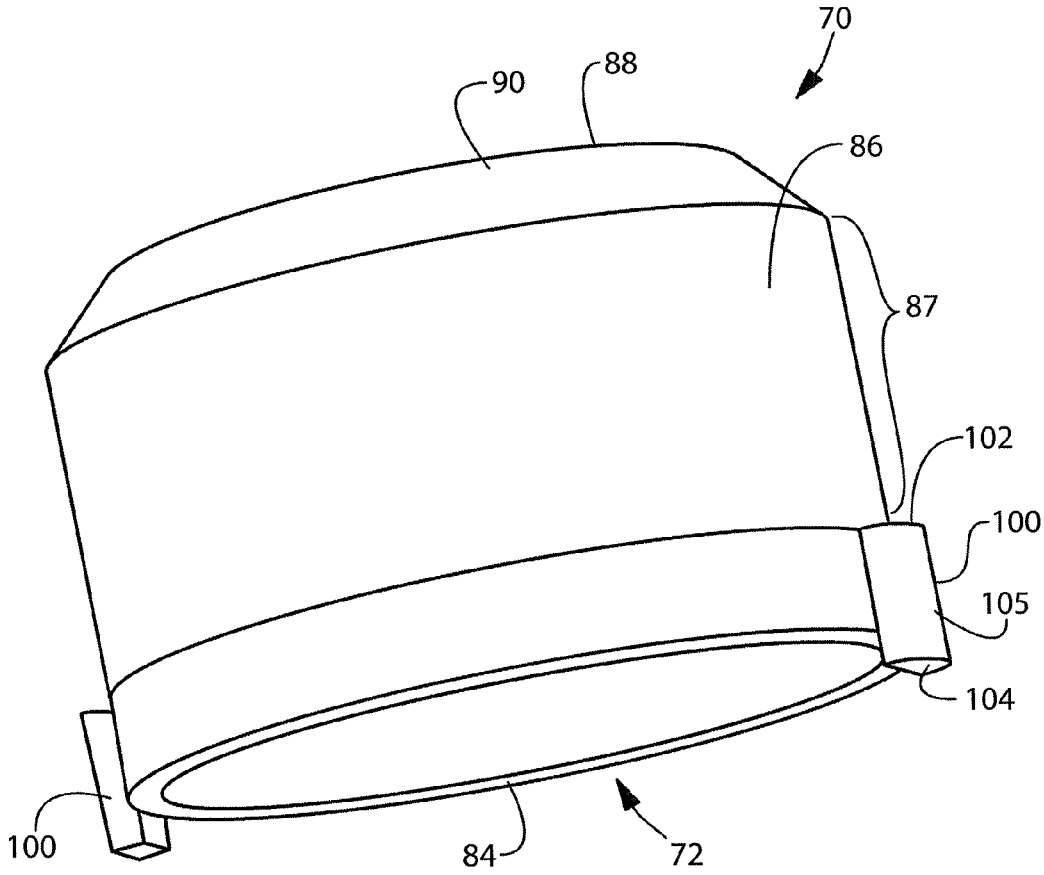
FIG. 3 illustrates a 3-D view of the cap member employed within the constant contact side bearing assembly of FIG. 1.
Figure 4:
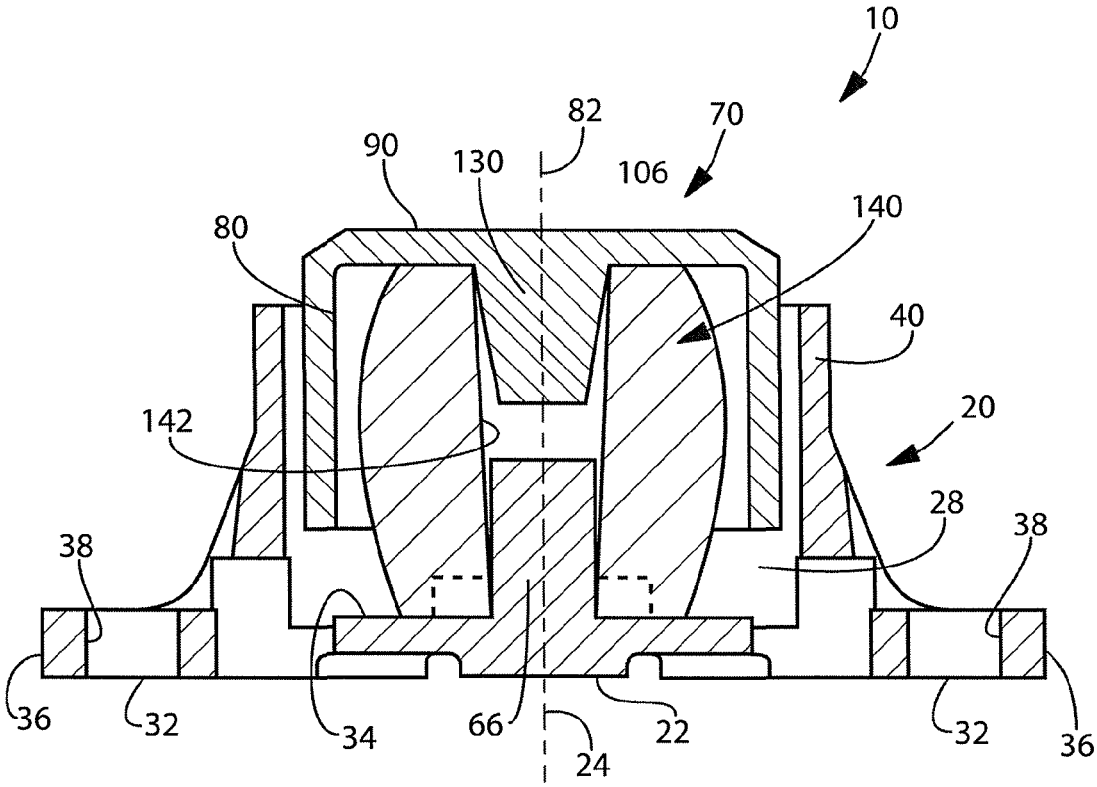
FIG. 4 is a cross-sectional elevation view of the constant contact side bearing assembly of FIG. 1.
Figure 5:
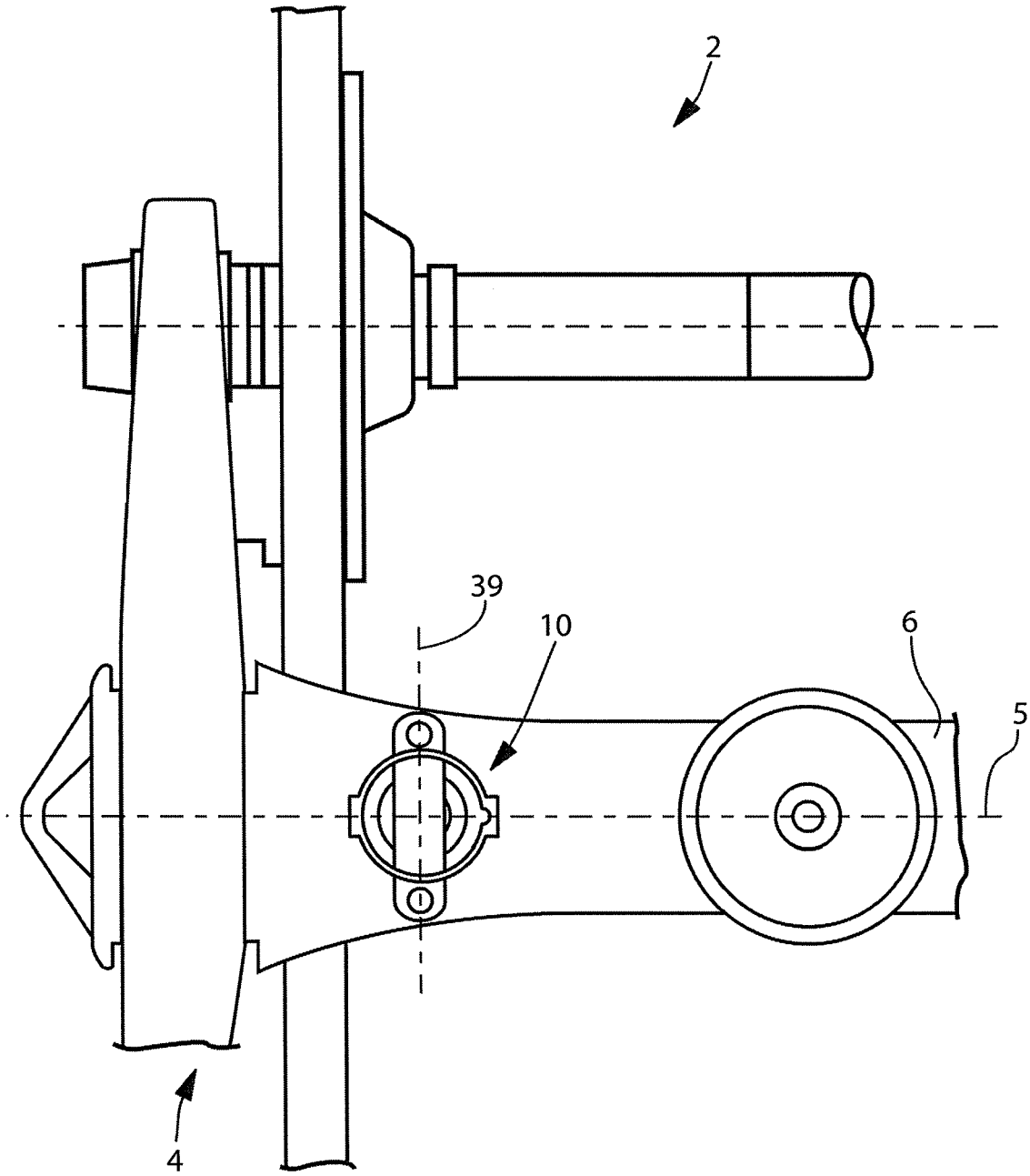
FIG. 5 is an environmental planar view illustrating use of the constant contact side bearing assembly of FIG. 1 within a railcar.

The cap 70, best shown in FIGS. 1, 3 and 4 is disposed for reciprocal axial movement relative to the housing 20. The cap includes a generally cylindrical cap wall 80 defining a longitudinal axis 82 disposed coaxially with the longitudinal axis 24 of the housing 20. The cap wall 80 has each of a predetermined height and a predetermined diameter. The exterior surface 86 of the cap wall 82 has a generally even circumferential region 87 which does not include protrusions or cavities other than small irregularities that are common to a casting process by which the cap 70 of the present invention is manufactured. Such circumferential region 87 is to be machined in order to achieve close tolerance spacing with machined interior surface 43 of the housing wall 40 of the housing 20.

The cap 70 also has a generally open bottom end 72 defining a bottom edge 84 of the cap wall 80. There is also a generally closed top end 90 that carries thereon a top edge 88 of the cap wall 80.

There is also a pair of diametrically opposed tabs 100 disposed on the exterior side surface 86 of the cap wall 80 and aligned along the axis disposed substantially perpendicular to the mounting axis 39. Each of the pair of diametrically opposed tabs 100 is sized for operative engagement with a respective one of the pair channels 50. The upper edge 102 of each tab 100 is positioned below the circumferential region 87. The criticality of such positioning is in that the tabs 100 do not interfere with continuous machining of the exterior surface 86 of the cap 70 by a turning process on the lathe while the cap is rotating about the longitudinal axis 82 (wherein the cutting tool travels along a path being parallel to the axis 82 while cap 70 is being rotated).

If required, in order to meet operating rigors, the portion of each tab 100 carrying a lower edge 104 thereof may be extended outwardly below the bottom edge 84 of the cap 70 and is then allowed to pass into the opening 60 of the housing 20. The height of each tab 100 is sized so as to allow contact between the bottom edge 84 of the cap 70 and the top surface 34 of the base 30 during operation of the side bearing assembly 10.

The exterior surface 105 of each tab 100 may be allowed to contact or abuttingly engage the interior surface 54 of the respective channel 50 during reciprocal axial movement of the cap 70.

The cap 70 is also adapted with a second elongated guide member 130 disposed centrally on and upstanding from an inner surface 106 of the top end 90 of the cap 70.

The one piece elastomeric spring 140, the final essential element of the side bearing assembly 10 best shown in FIG. 4, is disposed within a generally closed chamber 28 formed by a combination of the housing 20 and the cap 70. The spring 140 has an axial bore 142 thereof sized to receive each of the first and second guide members, 66 and 130 respectively.

Although the present invention has been shown in terms of the side bearing assembly 10 having a pair of channels 50 and a pair of complimentary tabs 100, it will be apparent to those skilled in the art, that greater quantity of channels 50 and tabs 100 may be employed to withstand the operational rigors while allowing uninterrupted machining of the region 87.

Furthermore, the cap may be adapted with additional openings (not shown) disposed adjacent the closed top end 90 thereof in order to facilitate cooling of the piece elastomeric spring 140.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A constant contact side bearing assembly for a railcar comprising:

(a) a housing including:

(i) a base having a substantially planar bottom surface thereof abuttingly engaging a bolster of a railcar truck and defining a bottom end of said housing;

(ii) a pair of mounting apertures formed through a thickness of said base and aligned along a mounting axis disposed each of generally perpendicular to an axis of such bolster and in a movement direction of such railcar, (iii) a generally cylindrical housing wall upstanding on said base and defining an upstanding longitudinal axis of said housing generally intersecting said mounting axis of said mounting apertures, said housing wall having each of a predetermined height and a predetermined diameter, (iv) a pair of diametrically opposed channels disposed on and extending outwardly from an exterior surface of said housing wall in open communication with an interior thereof and aligned along an axis disposed substantially perpendicular to said mounting axis, each of said pair of diametrically opposed channels has a generally U-shaped cross-section in a plane transverse to said longitudinal axis of said housing, (v) a pair of diametrically opposed openings formed at least through a thickness of said base, each of said pair of diametrically opposed openings disposed in general alignment with a respective one of said pair of channels, and (vi) a first guide member disposed centrally on and upstanding from an inner surface of said base member;

(b) a cap disposed for reciprocal axial movement relative to said housing along said upstanding longitudinal axis thereof, said cap including:

(i) a generally cylindrical cap wall defining a longitudinal axis of said cap disposed coaxially with said longitudinal axis of said housing, said cap having each of a predetermined height and a predetermined diameter, (ii) a generally even circumferential region of an exterior surface of said cap wall providing for an uninterrupted machining of said exterior surface during rotation of said cap about said longitudinal axis thereof wherein a cutting tools travels along a pass being parallel to said longitudinal axis of said cap, (iii) a generally closed top end having a pair of substantially planar surfaces and carrying thereon a top edge of said cap wall, (iv) a generally open bottom end defining a bottom edge of said cap wall, (v) a pair of diametrically opposed tabs disposed on said exterior surface of said cap wall, each of said pair of diametrically opposed tabs each of sized and shaped for operative engagement with a respective one of said pair of channels, wherein an upper edge of each of said pair of diametrically opposed tabs disposed at or below said generally even circumferential region of said cap wall and whereby combination of said channels and tabs is sized to withstand rigors of an operating environment of the railcar, and (vi) a second guide member disposed centrally on and upstanding on an inner surface of said top end of said cap; and (c) a one piece elastomeric spring disposed within a generally closed chamber formed by a combination of said housing and said cap, said spring having an axial bore sized to receive each of said first and second positioning members.

2. The constant contact side bearing assembly, according to claim 1, wherein a bottom portion of said each of said pair of diametrically opposed tabs extends outwardly relative said bottom edge of said cap wall.

3. The constant contact side bearing assembly, according to claim 2, wherein said bottom portion of said each of said pair of diametrically opposed tabs is received within a respective one of said pair of diametrically opposed openings formed at least through said thickness of said base.

4. The constant contact side bearing assembly, according to claim 3, wherein a bottom edge of said cap is allowed to contact a top surface of said base.

5. The constant contact side bearing assembly, according to claim 4, wherein said pair of second diametrically opposed openings are further formed through a thickness of said base.

6. The constant contact side bearing assembly, according to claim 1, wherein said housing includes a pair of second diametrically opposed openings formed through at least a thickness of said housing wall and aligned along said mounting axis.

7. The apparatus, according to claim 1, wherein an exterior surface of said of said pair of diametrically opposed tabs abutingly engages an interior surface of said respective channel during said reciprocal axial movement of said cap.

8. A constant contact side bearing assembly for a railcar comprising:

(a) a housing including:

(i) a base having a substantially planar bottom surface thereof abuttingly engaging a bolster of a railcar truck and defining a bottom end of said housing;

(ii) a pair of mounting apertures formed through a thickness of said base and aligned along a mounting axis disposed each of generally perpendicular to an axis of such bolster and in a movement direction of such railcar, (iii) a generally cylindrical housing wall upstanding on said base and defining an upstanding longitudinal axis of said housing generally intersecting said mounting axis of said mounting apertures, said housing wall having each of a predetermined height and a predetermined diameter, (iv) at least a pair of diametrically opposed channels disposed on and extending outwardly from an exterior surface of said housing wall in open communication with an interior thereof and aligned along an axis disposed substantially perpendicular to said mounting axis, each of said at least pair of diametrically opposed channels has a generally U-shaped cross-section in a plane transverse to said longitudinal axis of said housing, (v) at least a pair of diametrically opposed openings formed at least through a thickness of said base, each of said at least pair of diametrically opposed openings disposed in general alignment with a respective one of said at least pair of channels, and (vi) a first guide member disposed centrally on and upstanding from an inner surface of said base member;

(b) a cap disposed for reciprocal axial movement relative to said housing along said upstanding longitudinal axis thereof, said cap including:

(i) a generally cylindrical cap wall defining a longitudinal axis of said cap disposed coaxially with said longitudinal axis of said housing, said cap having each of a predetermined height and a predetermined diameter, (ii) a generally even circumferential region of an exterior surface of said cap wall providing for an uninterrupted machining of said exterior surface during rotation of said cap about said longitudinal axis thereof wherein a cutting tools travels along a pass being parallel to said longitudinal axis of said cap, (iii) a generally closed top end having a pair of substantially planar surfaces and carrying thereon a top edge of said cap wall, (iv) a generally open bottom end defining a bottom edge of said cap wall, (v) at least a pair of diametrically opposed tabs disposed on said exterior surface of said cap wall, each of said at least pair of diametrically opposed tabs each of sized and shaped for operative engagement with a respective one of said at least pair of channels, wherein an upper edge of each of said at least pair of diametrically opposed tabs disposed at or below said generally even circumferential region of said cap wall and whereby the combination of said channels and tabs is sized to withstand rigors of an operating environment of the railcar, and (vi) a second guide member disposed centrally on and upstanding on an inner surface of said top end of said cap; and (c) a one piece elastomeric spring disposed within a generally closed chamber formed by a combination of said housing and said cap, said spring having an axial bore sized to receive each of said first and second positioning members.

9. A cap for a constant contact side bearing assembly having a housing, said cap disposed for reciprocal axial movement relative to the housing of along an upstanding longitudinal axis thereof, said cap comprising:

(a) a generally cylindrical cap wall defining a longitudinal axis of said cap disposed coaxially with the longitudinal axis of the housing, said cap having each of a predetermined height and a predetermined diameter;

(b) a generally even circumferential region of an exterior surface of said cap wall providing for an uninterrupted machining of said exterior surface during rotation of said cap about said longitudinal axis thereof wherein a cutting tools travels along a pass being parallel to said longitudinal axis of said cap;

(c) a generally closed top end having a pair of substantially planar surfaces and carrying thereon a top edge of said cap wall;

(d) a generally open bottom end defining a bottom edge of said cap wall;

(e) at least a pair of diametrically opposed tabs disposed on said exterior surface of said cap wall, each of said at least pair of diametrically opposed tabs each of sized and shaped for operative engagement with a respective one of at least pair of channels disposed on the housing, wherein an upper edge of each of said at least pair of diametrically opposed tabs disposed at or below said generally even circumferential region of said cap wall and whereby the combination of the channels and said tabs is sized to withstand rigors of an operating environment of the railcar; and (f) a guide member disposed centrally on and upstanding on an inner surface of said top end of said cap.

10. The cap, according to claim 9, wherein the housing includes at least a pair of openings formed at least through a base of the housing, each of said at least pair of openings sized to receive a respecting on of said at least pair of tabs therewithin.

* * * * *